US005862703A

United States Patent [19]

Tsai

[11] Patent Number: 5,862,703

[45] Date of Patent: Jan. 26, 1999

[54] TRANSMISSION MECHANISM FOR OUTWARD TURNING WHEEL SET OF TOY CAR

[76] Inventor: Wen-Ho Tsai, 8F, No.113, Yu Jen Rd., Taipei, Taiwan

[21] Appl. No.: 931,514

[22] Filed: Sep. 16, 1997

[51] Int. Cl.[6] ..... A63H 17/00; B26D 61/12

[52] U.S. Cl. ..... 74/53; 74/25; 446/465; 180/209

[58] Field of Search ..... 446/465, 466; 74/53, 54, 55, 25, 471 R; 180/209; 280/5.52, 5.521

[56] References Cited

U.S. PATENT DOCUMENTS 4,457,099 7/1984 Kozuka et al. ..... 446/466
4,810,229 3/1989 Shoji ..... 446/469
5,372,534 12/1994 Levy et al. ..... 180/209
5,549,501 8/1996 Jow ..... 446/466
5,785,576 7/1998 Belton ..... 446/466

*Primary Examiner*—Charles A. Marmor
*Assistant Examiner*—William C Joyce
*Attorney, Agent, or Firm*—Bacon & Thomas, PLLC

[57] ABSTRACT

A transmission mechanism for an outward turning wheel set of a toy car, including a casing and a gear set, wherein the gear set is received in the casing and driven by a motor to rotate a cam. The cam is driven to forcedly swing a cantilever between a first and a second position. The cantilever has a free end connected with a pressing lever. When the cantilever is swung to the second position, an elevating seat, a board member and a slide block are pressed downward, whereby when the car body is lifted, a linkage and multiple elbow joints forcedly turn the car wheels outward.

7 Claims, 3 Drawing Sheets

TRANSMISSION MECHANISM FOR OUTWARD TURNING WHEEL SET OF TOY CAR

BACKGROUND OF THE INVENTION

The present invention relates to a transmission mechanism for outward turning wheel set of toy car.

A conventional toy car is able to emit sound and light during moving. Such toy car lacks attractivity nowadays. In order to create novel entertaining effect, the existing toy car is designed with versatile operations during moving. For example, the car body can be moved up and down and the car wheels can be turned and displaced . Generally, for sequentially or simultaneously outward turning four car wheels during moving, two symmetrical sets of transmission mechanisms are necessary. This complicates the structure of the toy car and increases the manufacturing cost thereof .

SUMMARY OF THE INVENTION

It is therefore a primary object of the present invention to provide a simple transmission mechanism for outward turning wheel set of toy car. The transmission mechanism includes a casing and a gear set received in the casing and driven by a motor to rotate a cam. The cam is driven to forcedly swing a cantilever between a first and a second positions. The cantilever has a free end connected with a pressing lever. When the cantilever is swung to the second position, an elevating seat, a board member and a slide block are pressed downwar, whereby when the car body is lifted, a linkage and multiple elbow joints forcedly turn four car wheels outward at the same time.

The present invention can be best understood through the following description and accompanying drawings, wherein:

BRIEF DESCRIPTION OF THE DRAWINGS

FIG. 2 is a perspective assembled view according to

FIG. 1, showing the operation of the present invention; and

DETAILED DESCRIPTION OF THE PREFERRED EMBODIMENT

Figure 1:
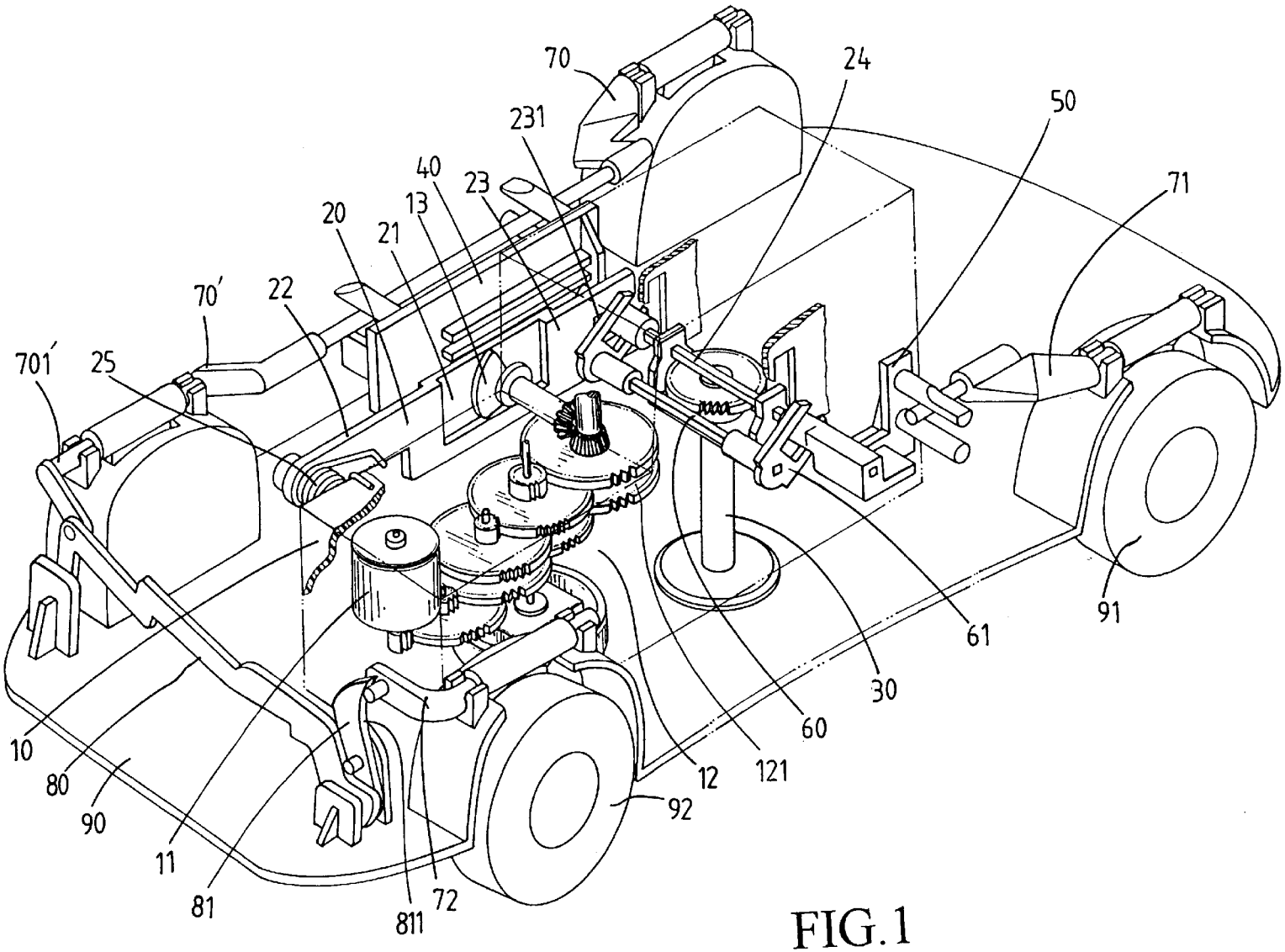
FIG. 1 is a perspective assembled view of the present invention.

Please refer to FIG. 1. The present invention includes a motor 11 disposed in a casing 10 and a gear set 12 driven by the motor 11. The gear set 12 includes a driven gear 121 engaged with a cam 13 extending out of the casing 10. The cam 13 is positioned at an abdomen section 21 of a cantilever 20. The cantilever 20 has a fixed end 22 pivotally connected on the casing 10 and a free end 23 swinging between a first and a second positions in response to the rotation of the cam 13.

The free end 23 is formed with a notch 231, permitting a pressing lever 24 to pass through an elevating seat 30. One end of the pressing lever 24 is pivotally connected with a board member 40 and a slide block 50, whereby when the pressing lever 24 is moved downward, the board member 40 is forcedly moved along with the pressing lever 24.

A clamping device 60 is transversely pivotally supported on the casing 10. The clamping device 60 has two clamping legs 61 respectively clamping two ends of the pressing lever 24. When the cantilever 20 is swung downward, the two ends of the pressing lever 24 can evenly force the elevating seat 30 and the board member 40 and the slide block 50 to move downward.

The board member 40 and slide block 50 are connected with elbow joints 70, 70' and 71 which are rotatable in response to the up and down movement thereof. One end 701' of the elbow joint 70' is pivotally connected with a linkage 80 having a swinging hook member 81. The hook member 81 is connected with the elbow joint 72, whereby when the linkage 80 is moved, the hook member 81 can drive the elbow joint 72.

Figure 2:
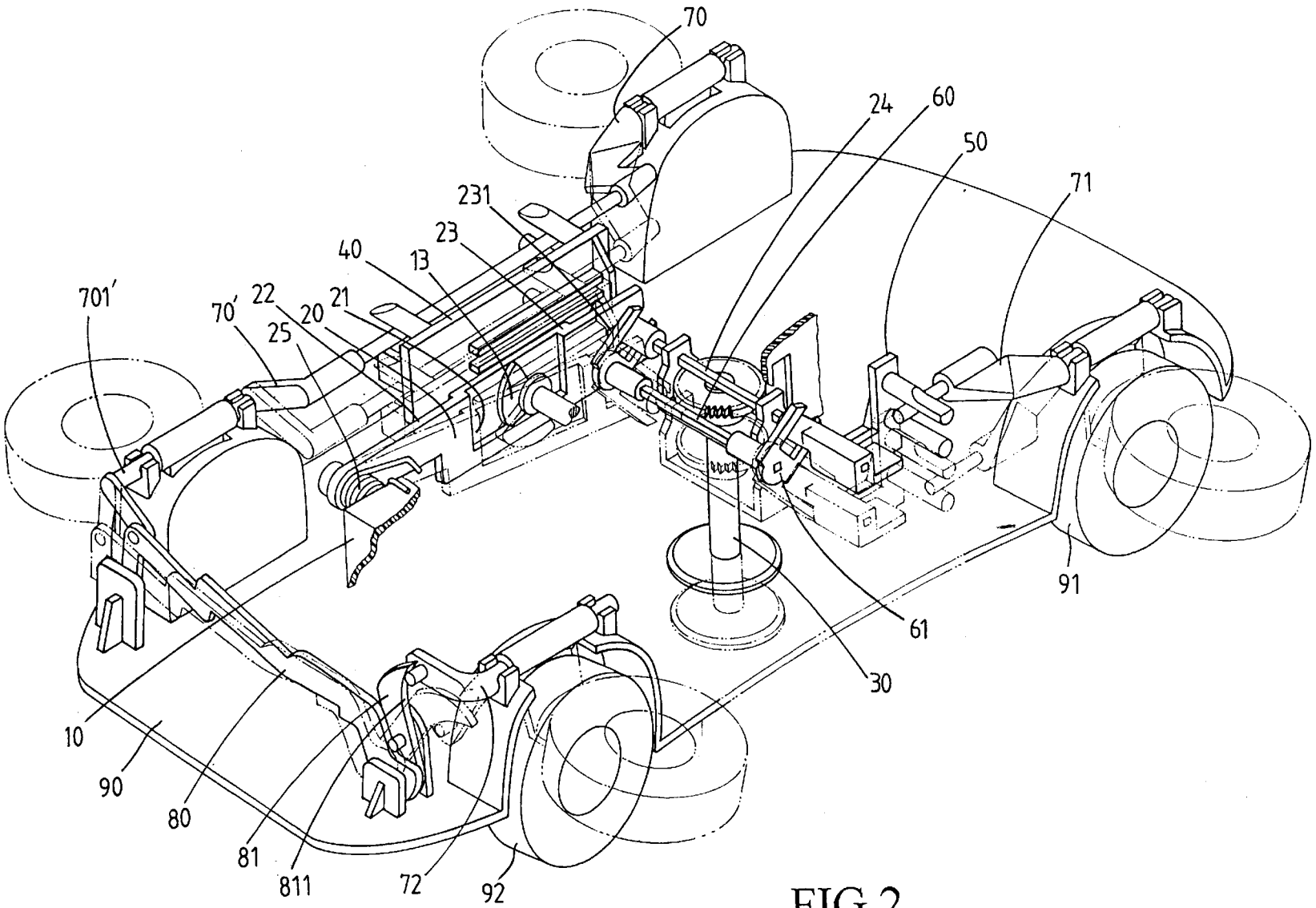
Figure 3:
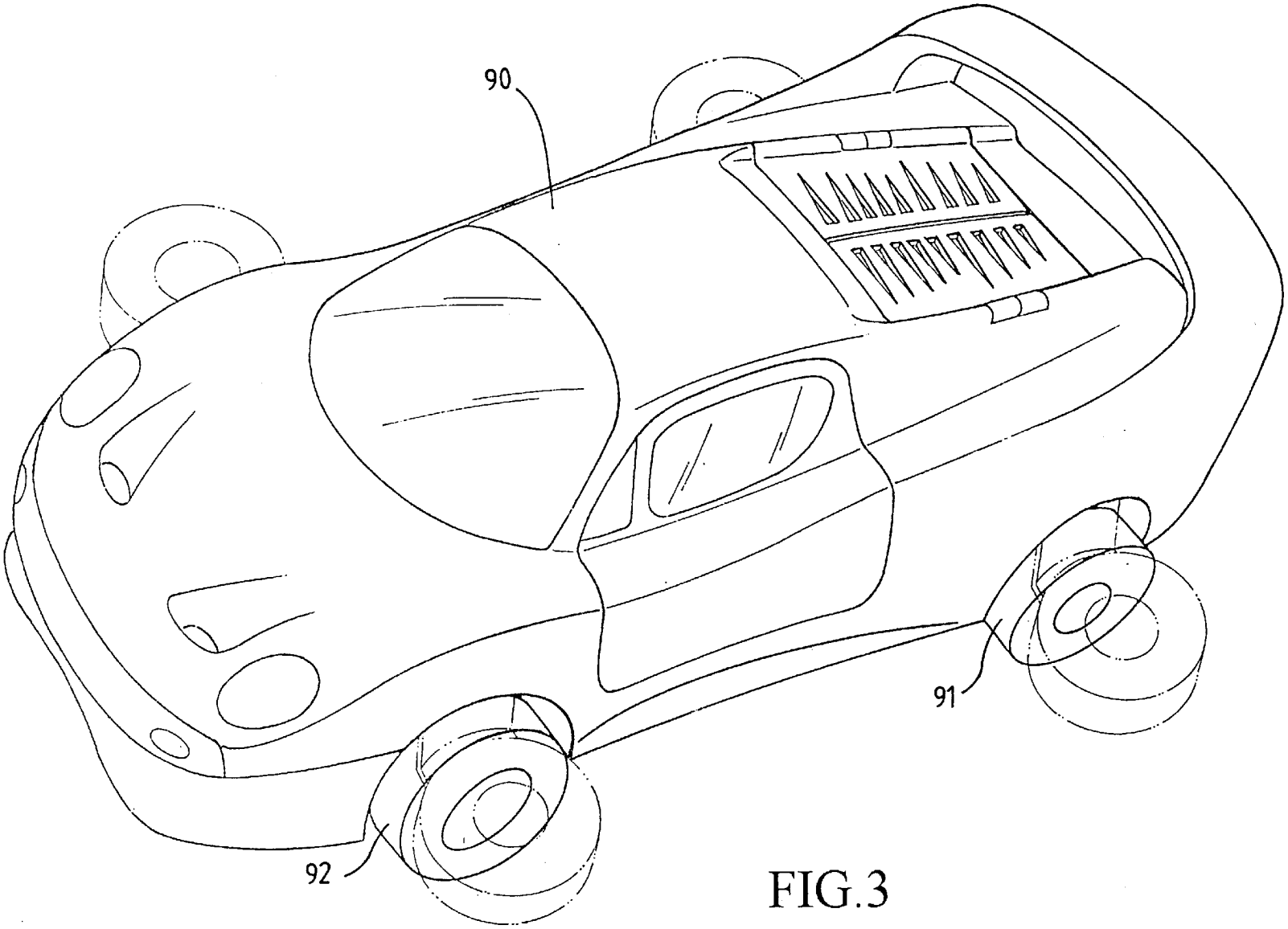
FIG. 3 shows the appearance of the present invention.

Referring to FIGS. 2 and 3, when the motor 11 and the gear set 12 drive the driven gear 121 to rotate the cam 13, the cam 13 forces the cantilever 20 to swing from the first position to the second position as shown by the phantom line. When the cantilever 20 is moved downward, the following movements take place:

1. The pressing lever 24 is forced to move downward, making the elevating seat 30 displaced downward to lift the car body 90.
2. In response to the movement of the pressing lever 24, the clamping legs 61 of the clamping device 60 are swung downward.
3. The board member 40 and the slide block 50 are moved downward as shown by the phantom line, whereby the elbow joints 70, 70' and 71 are driven to gradually rotate downward from a substantially horizontal position. At this time, the car wheel 91 is driven and turned outward.
4. When the elbow joint 70' is rotated downward, the other end 701' thereof will lift the linkage 80, making the hook member 81 depress the elbow joint 72 as shown by the phantom line. At this time, the car wheel 92 is also turned outward.

After the cam 13 is rotated through a preset range to pass over the abdomen section 21 of the cantilever, a resilient member 25 disposed at the fixed end 22 will make the cantilever 20 move back to the first position as shown by the solid line.

The end face 811 of the hook member 81 of the linkage 80, which contacts with the elbow joint 72 is preferably an arch face. This facilitates and smoothens the displacement of the elbow joint 72.

According to the above arrangement, the cantilever 20 can drive the elbow joints 70, 70', 71 and 72 and the linkage 80 at the same time.

It should be noted that the above description and accompanying drawings are only used to illustrate one embodiment of the present invention, not intended to limit the scope thereof. Any modification of the embodiment should fall within the scope of the present invention.

What is claimed is:

1. A transmission mechanism for an outward turning wheel set of a toy car, comprising a casing and a gear set, wherein the gear set is received in the casing, and driven by a motor, said transmission mechanism being characterized in that:

a cam is driven to rotate by the gear set;

a cantilever is swung between a first and a second position in response to the rotation of the cam, the cantilever having a fixed end and a free end;

a pressing lever is movable in response to the swinging of the cantilever, wherein the pressing lever engages an elevating seat to move the elevating seat downward;

a board member and a slide block are respectively pivotally connected with two ends of the pressing lever;

multiple elbow joints are respectively connected with the board member and the slide block and rotatable in response to the movement thereof; and a linkage connected to an end of one of the elbow joints, whereby when the cantilever is moved to the second position, an additional elbow joint is forcedly outward turned by the linkage.

2. A transmission mechanism as claimed in claim 1, wherein the cam is positioned at an abdomen section of the cantilever and extends out of the casing.

3. A transmission mechanism as claimed in claim 1, wherein two ends of the pressing lever are respectively clamped by two clamping legs of a clamping device pivotally disposed on the casing.

4. A transmission mechanism as claimed in claim 1, wherein the fixed end of the cantilever and a resilient member are pivotally connected together with one side of the casing.

5. A transmission mechanism as claimed in claim 1, wherein the free end of the cantilever is formed with a notch, permitting the pressing lever to pass therethrough.

6. A transmission mechanism as claimed in claim 1, wherein an end of the linkage is connected with a swinging hook member which connects with the additional elbow joint.

7. A transmission mechanism as claimed in claim 6, wherein an end face of the hook member which contacts with the additional elbow joint is an arch face.

* * * * *